US008920148B2

(12) United States Patent
Nakagawa et al.

(10) Patent No.: US 8,920,148 B2
(45) Date of Patent: Dec. 30, 2014

(54) OIL PUMP

(75) Inventors: Masateru Nakagawa, Kariya (JP); Nobukazu Ike, Kariya (JP); Takuro Iwase, Anjo (JP); Tomohiro Umemura, Aichi-ken (JP); Noriyasu Ariga, Okazaki (JP); Katsunori Ishikawa, Nishio (JP); Masashi Narita, Toyota (JP)

(73) Assignees: Aisin AW Co., Ltd., Aichi-ken (JP); Toyooki Kogyo Co., Ltd., Aichi-ken (JP)

( * ) Notice: Subject to any disclaimer, the term of this patent is extended or adjusted under 35 U.S.C. 154(b) by 371 days.

(21) Appl. No.: 13/014,034

(22) Filed: Jan. 26, 2011

(65) Prior Publication Data

US 2011/0194968 A1 Aug. 11, 2011

(30) Foreign Application Priority Data

Feb. 5, 2010 (JP) ..... 2010-024870

(51) Int. Cl.

| | |
|---|---|
| ***F01C 1/00*** | (2006.01) |
| ***F01C 1/08*** | (2006.01) |
| ***F04C 15/00*** | (2006.01) |
| ***F04C 2/08*** | (2006.01) |
| ***F04C 2/10*** | (2006.01) |

(52) U.S. Cl.

CPC ..... *F04C 15/0042* (2013.01); *F04C 2/088* (2013.01); *F04C 2/102* (2013.01); *F04C 2210/14* (2013.01); *F04C 2250/10* (2013.01)

USPC ..... 418/166; 418/171; 418/161; 418/160; 418/164; 418/61.2; 418/61.1

(58) Field of Classification Search

CPC ..... F04C 15/0042; F04C 2/102; F04C 2/008

USPC ..... 418/160, 161, 164, 166, 171, 61.2, 61.1

See application file for complete search history.

(56) References Cited

U.S. PATENT DOCUMENTS

| | | | | |
|---|---|---|---|---|
| 4,767,296 | A | 8/1988 | Satomoto et al. | |
| 6,544,021 | B2 * | 4/2003 | Watanabe et al. | 418/171 |

(Continued)

FOREIGN PATENT DOCUMENTS

| | | | |
|---|---|---|---|
| JP | 7-35053 | A | 2/1995 |
| JP | 2582167 | B2 | 11/1996 |

(Continued)

OTHER PUBLICATIONS

International Search report for PCT/JP2011/050511 dated Apr. 12, 2011.

(Continued)

*Primary Examiner* — Thomas Denion

*Assistant Examiner* — Anthony Ayala Delgado

(74) *Attorney, Agent, or Firm* — Sughrue Mion, PLLC

(57) ABSTRACT

An oil pump having an inner rotor with of external teeth; an outer rotor that is eccentrically provided and has internal teeth that mesh with the inner rotor external teeth, and an oil pump body that accommodates the outer and inner rotors. By rotationally driving the inner rotor to increase and decrease a space between the internal and the external teeth, an intake stroke suctions hydraulic oil from the oil pump body and a discharge stroke discharges the suctioned hydraulic oil to a discharge port formed in the oil pump body. Between the intake and discharge strokes, a confinement stroke cuts off the suctioned hydraulic oil and confines the suctioned hydraulic oil in the space, and a compression stroke reduces the space and compresses the confined hydraulic oil. Further, an interval is set between a finish end portion of the intake port of the oil pump body and a start end portion of the discharge port such that a rotation angle of the inner rotor during the compression stroke is 21 to 27 degrees.

2 Claims, 6 Drawing Sheets

(56) References Cited

U.S. PATENT DOCUMENTS

| | | | | |
|---|---|---|---|---|
| 6,835,054 | B2 | 12/2004 | Morita | |
| 7,052,258 | B2 * | 5/2006 | Amano et al. | 418/171 |
| 7,699,590 | B2 * | 4/2010 | Matsuo et al. | 418/171 |
| 2004/0161354 | A1 * | 8/2004 | Morita | 418/15 |
| 2005/0019196 | A1 * | 1/2005 | Enzaka et al. | 418/206.4 |
| 2006/0140809 | A1 * | 6/2006 | Enzaka et al. | 418/61.3 |

FOREIGN PATENT DOCUMENTS

| | | | |
|---|---|---|---|
| JP | 11-093853 | A | 4/1999 |
| JP | 2003-227474 | A | 8/2003 |
| JP | 2004-245151 | A | 9/2004 |
| JP | 2004-332696 | A | 11/2004 |
| JP | 2006-183569 | A | 7/2006 |
| JP | 2005-42689 | A | 2/2011 |

OTHER PUBLICATIONS

Partial Translation of Notification of Reason(s) for Refusal, dated Oct. 1, 2013, issued in corresponding Japanese Patent Application No. 2010-024870.

* cited by examiner

OIL PUMP

INCORPORATION BY REFERENCE

The disclosure of Japanese Patent Application No. 2010-024870 filed on Feb. 5, 2010 including the specification, drawings and abstract is incorporated herein by reference in its entirety.

BACKGROUND OF THE INVENTION

The present invention relates to an oil pump installed in an automatic transmission or the like, for example. More specifically, the present invention relates to an oil pump that suctions and discharges hydraulic oil by meshing external teeth of an inner rotor with internal teeth of an eccentrically-formed outer rotor, and increasing and decreasing a space between the inner rotor and the outer rotor.

DESCRIPTION OF THE RELATED ART

In general, inscribed oil pumps as typified by a trochoid oil pump, for example, are widely known as oil pumps used in vehicles such as automobiles.

Inscribed oil pumps are configured by meshing external teeth of an inner rotor with internal teeth of an eccentric outer rotor. Rotational driving of the inner rotor causes a space between the inner and outer rotors to increase along an intake port to suction hydraulic oil, and decrease toward a discharge port so as to discharge the suctioned hydraulic oil.

In this type of oil pump, when the rotor rotates at high speed, a negative pressure on the intake port side of the space becomes partially lower than a saturated vapor pressure of the hydraulic oil. As a consequence, the hydraulic oil vaporizes and causes cavitation (air bubbles) in the space.

When cavitation occurs, the liquid hydraulic oil becomes a gas whose volume sharply increases. In addition to the risk of the oil pump discharge amount becoming insufficient, the space communicates with the discharge port and an internal pressure of the space becomes equal to or greater than the saturated vapor pressure of the hydraulic oil, which eliminates a cavitation at a specific location but also generates a jet stream that causes erosion in the oil pump.

When a cavitation disappears, surrounding hydraulic oil rushes toward the center of the air bubble and the subsequent collision of hydraulic oil generates a pressure wave. This pressure wave becomes cavitation noise, and increases noise and vibration in the oil pump.

In order to suppress such erosion and cavitation noise, related art proposes an oil pump in which a pressure reducing shallow groove D for supplying hydraulic oil from a delivery port 5 is formed in a space part (gap part) S at the time of a maximum volume $V_{max}$ (see Japanese Patent No. 2582167).

SUMMARY OF THE INVENTION

The oil pump of Japanese Patent No. 2582167 is effective against erosion because hydraulic oil flows from the delivery port into the space part through the pressure reducing shallow groove at the time of the maximum volume to increase the internal pressure of the space part, which reduces the difference between a discharge pressure and the internal pressure of the space part, and also reduces the momentum of the jet stream.

However, it is difficult to gradually increase the internal pressure of the space part with the above-described method of using hydraulic oil from the delivery port to increase the pressure of the space part, and at the stage of communication with the delivery port a certain amount of cavitation remains within the space part.

Such remaining cavitation is collectively eliminated as soon as the space part communicates with the delivery port. A loud cavitation noise is still generated as a consequence, so such a mechanism for reducing oil pump noise is still inadequate.

The present invention provides an oil pump that solves the above problem by providing a compression stroke between an intake stroke that suctions hydraulic oil and a discharge stroke that discharges hydraulic oil, and gradually smashing and eliminating cavitation in the compression stroke.

According to a first aspect of the present invention, a compression stroke that compresses an inter-rotor space is provided between an intake stroke and a discharge stroke. A rotation angle that an inner rotor advances during the compression stroke is set within a range of 21 to 27 degrees. Most cavitation occurring in the space can thus be gradually smashed and eliminated during the compression stroke, and oil pump noise can be kept within a range that does not cause the driver to feel discomfort. In addition, such cavitation disperses and disappears over time during the compression stroke instead of collectively disappearing at a specific site, which can help prevent the occurrence of erosion.

According to a second aspect of the present invention, at low revolution where cavitation does not occur, hydraulic oil compressed in the compression stroke can be discharged to a discharge port through a shallow groove. Therefore, an excessive increase in the pressure of the space during the compression stroke can be suppressed. In addition, noise at a meshing portion of the inner rotor and an outer rotor, as well as a decrease in fuel economy from the excessive increase in the internal pressure of the space can also be suppressed.

DETAILED DESCRIPTION OF THE EMBODIMENTS

Summary of Oil Pump

Figure 1A:
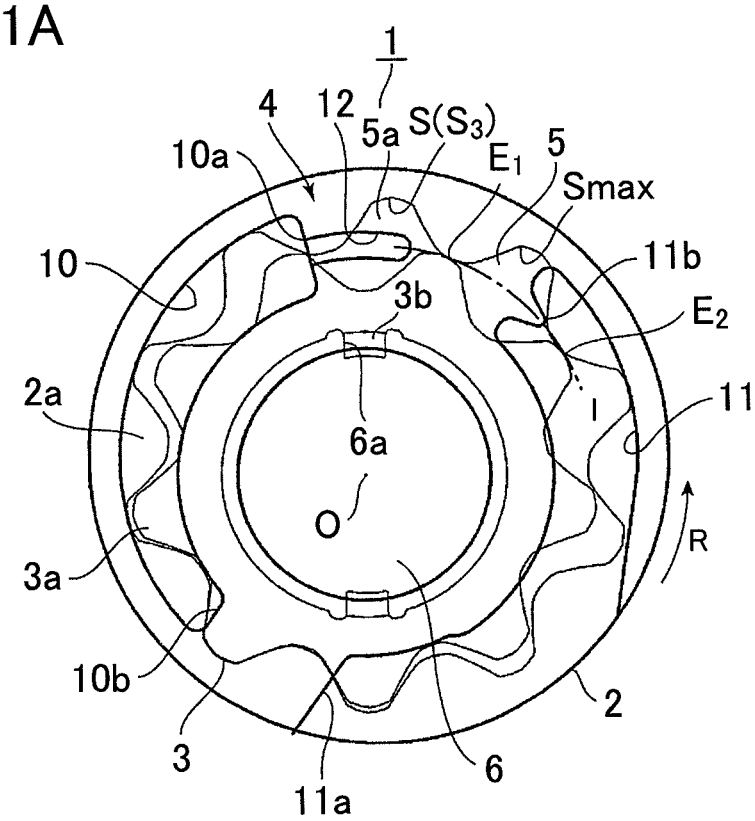
FIG. 1A is a frontal view of an essential portion of an oil pump according to an embodiment of the present invention, and shows a maximum volume of an inter-rotor space.
Figure 1B:
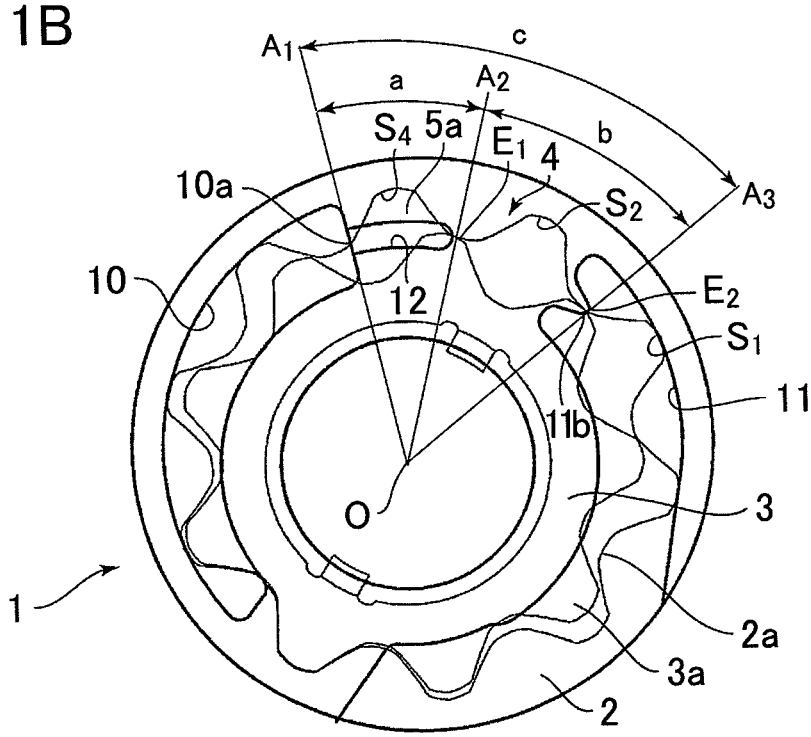
FIG. 1B is a frontal view of an essential portion of the oil pump according to the embodiment of the present invention, and shows the state of a stroke that closes the inter-rotor space.

An oil pump according to embodiments of the present invention will be described below with reference to the drawings. An oil pump 1 is provided between a speed change mechanism (not shown) constituted from a plurality of planetary gears and a torque converter (not shown) of an automatic transmission. As shown in FIGS. 1A and 1B, the oil pump 1 includes an inner rotor 3 that has external teeth 3*a* formed from a plurality of trochoidal teeth; an outer rotor 2 that has inner teeth 2*a* that mesh with the external teeth 3*a*; and an oil pump body 5 that accommodates the outer rotor 2 and the inner rotor 3.

A sliding surface 5*a* of the oil pump body 5 that slides against the inner rotor 3 and the outer rotor 2 is formed with an intake port 11 that communicates with an oil pan via a strainer, and a discharge port 10 that communicates with a control valve of the automatic transmission. The intake port 11 and the discharge port 10 oppose each other. In addition, the inner rotor 3 is fixedly attached through a key 3*b* and a key groove 6*a* to an oil pump drive shaft 6 that connects to an output shaft of a drive source.

The outer rotor 2 is eccentrically provided. Therefore, a space S formed between one pitch of the external teeth 3*a* and the internal teeth 2*a* has a volume that increases and decreases in accordance with the rotation of the inner rotor 3 and the outer rotor 2, when the inner rotor 3 is rotationally driven from an intake port 11 side to a discharge port 10 side (a rotation direction R in FIG. 1A).

Specifically, the space S is formed between an engagement point $E_1$ on a rotation forward side and an engagement point $E_2$ on a rotation rearward side of the external teeth 3*a* and the internal teeth 2*a*. As shown by a space $S_1$ in FIG. 1B, the volume of the space $S_1$ increases along the intake port 11, and becomes a maximum volume in the vicinity of a finish end portion 11*b* of the intake port 11 (a space $S_{max}$ in FIG. 1A).

Figure 2:
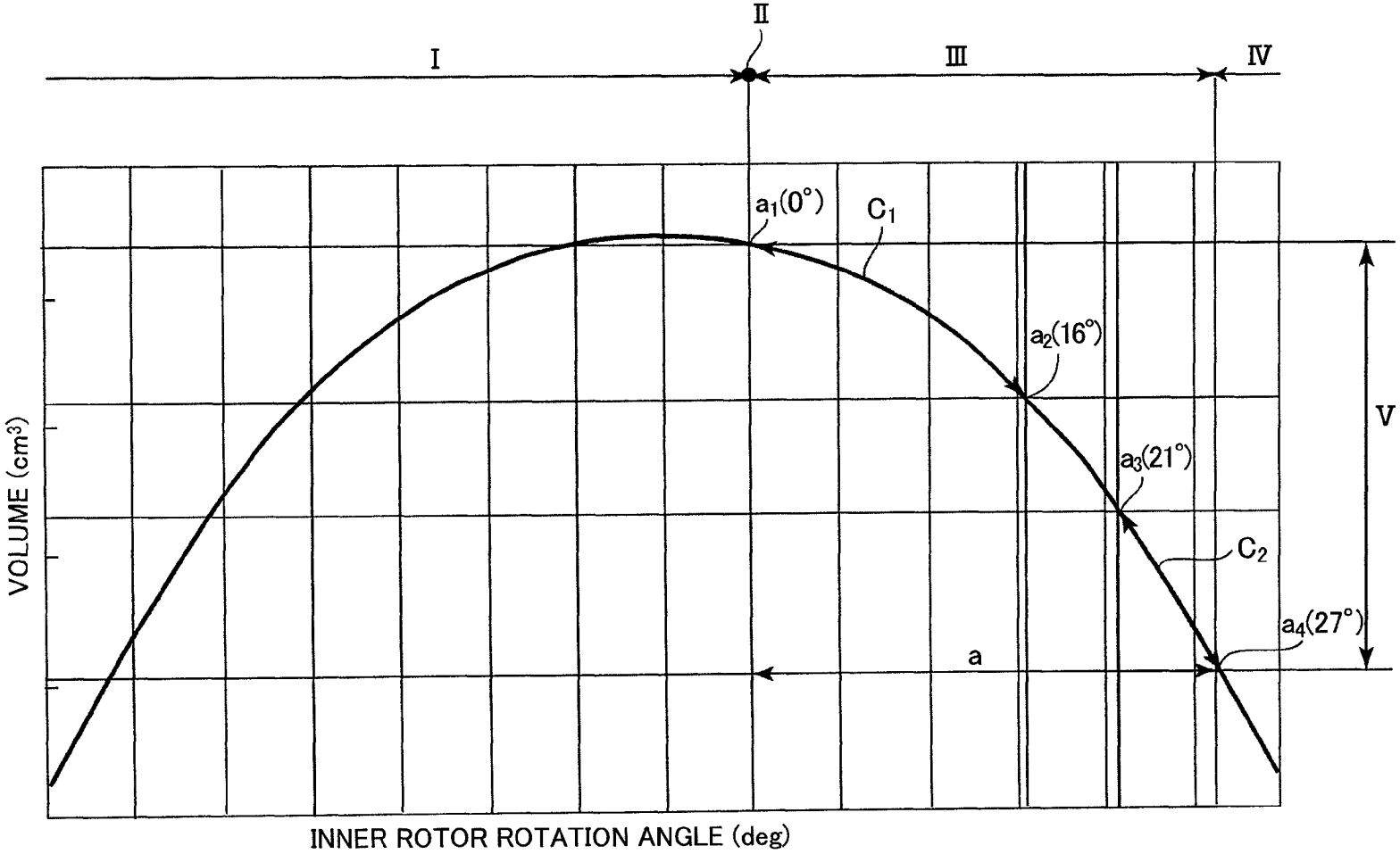
FIG. 2 is a graph of the oil pump according to the embodiment of the present invention, and shows the relationship between a volumetric change of the inter-rotor space and a rotation angle of an inner rotor.

As evident from FIG. 1A and FIG. 2, the space S increasing in volume along the intake port 11 thus causes hydraulic oil to be suctioned from the intake port 11 to inside the space S (an intake stroke I).

As shown by a space $S_2$ in FIG. 1B, once the engagement point $E_2$ on the rotation rearward side reaches the finish end portion 11*b* of the intake port 11, hydraulic oil suctioned into the space S as described above is cut off from the intake port 11 and confined in the space S (a confinement stroke II).

Between the finish end portion 11*b* of the intake port 11 and a start end portion 10*a* of the discharge port 10, a predetermined interval (angle) c is formed by an inter-port partition portion 4 that will be described in more detail later, and the inter-port partition portion 4 is configured so as to delay a discharge timing at which the engagement point $E_1$ on the rotation forward side communicates with the discharge port 10. Therefore, the volume of the space S, as shown by a space $S_3$ in FIG. 1A, is compressed after the position of the confinement stroke II until communication with the discharge port 10 (a compression stroke III).

Once the engagement point $E_1$ on the rotation forward side arrives at the start end portion 10*a* of the discharge port 10, as shown by a space $S_4$ in FIG. 1B, the space S communicates with the discharge port 10 and suctioned hydraulic oil is discharged to the discharge port 10 (a discharge stroke IV).

Note that the finish end portion 11*b* of the intake port 11 is formed with a recess portion at a radial position on a locus 1 formed by the engagement points $E_1$, $E_2$ so that more hydraulic oil can be suctioned into the space S, and a peak in the recess portion is the finish end portion 11*b* of the intake port 11 (see FIG. 1A).

Port Configuration of Oil Pump

Next, the port configuration of the oil pump 1 will be described. As mentioned above, the inter-port partition portion 4 provides a predetermined interval c between the finish end portion 11*b* of the intake port 11 and the start end portion 10*a* of the discharge port 11. The confinement stroke II and the compression stroke III occur within the predetermined interval c.

As shown in FIG. 1B, within the inter-port partition portion 4, the confinement stroke II occurs when the space S is fits within b, which is defined as between a line $A_2$ that connects a rotation center O of the inner rotor 3 and the engagement point $E_1$ on the rotation forward side in the space $S_2$ of the confinement stroke II, and a line $A_3$ that connects the rotation center O of the inner rotor 3 and the finish end portion 11*b* of the intake port 11.

Also, within the inter-port partition portion 4, the compression stroke III occurs between the engagement point $E_1$ on the rotation forward side during the confinement stroke II and the start end portion 10*a* of the discharge port 10. In other words, referring to FIG. 2, an angle a between the line $A_2$ and a line $A_1$ that connects the rotation center O of the inner rotor 3 and the start end portion 10*a* of the discharge port 10 becomes a compression angle that is a rotation angle of the inner rotor 3 when performing the compression stroke. The volume of the reduced space S within the compression angle a is a compression volume V that is compressed during the compression stroke.

Further, spanning the compression angle a, the sliding surface 5*a* of the oil pump body 5 is provided with a shallow groove 12 that communicates with the space $S_3$ and the start end portion 10*a* of the discharge port 10 during the compression stroke. The shallow groove 12 is positioned on the locus 1 formed by the engagement points $E_1$, $E_2$.

Note that, in the inter-port partition portion 4, the shallow groove 12 is formed extremely shallow so as to follow the engagement points $E_1$, $E_2$ of the inner rotor 3 and the outer rotor 2. The shallow groove 12 is also formed such that the space $S_2$ does not communicate with the intake port 11 and the discharge port 10 in the confinement stroke II. For example, with regard to the rotation angle of the inner rotor 3, a distal end portion of the shallow groove 12 is provided at a position where the rotation angle is advanced approximately 1 to 3 degrees more than 0 degrees with respect to the engagement point $E_1$. When the drive source (inner rotor 3) rotates at low speed and there is a small flow of hydraulic oil, the shallow groove 12 acts as a groove that discharges hydraulic oil within the space S to the discharge port 10. The shallow groove 12 also ensures that when the drive source rotates at high speed and there is a large flow of hydraulic oil, hydraulic oil that may affect the internal pressure of the space S does not flow to the discharge port 10.

Figure 3A:
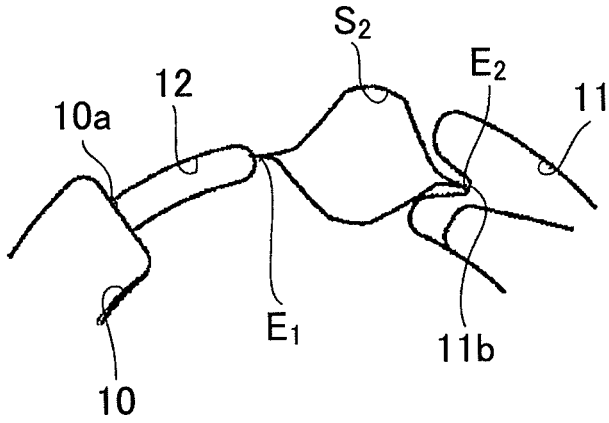
FIG. 3A is a schematic diagram that shows a port configuration of the oil pump according to the embodiment of the present invention, and shows an example that includes a shallow groove for draining pressure.
Figure 3B:
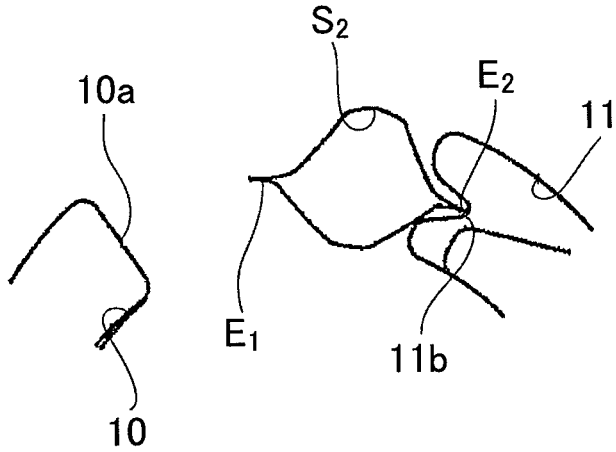
FIG. 3B shows an example that does not include the shallow groove for draining pressure in FIG. 3A.
Figure 3C:
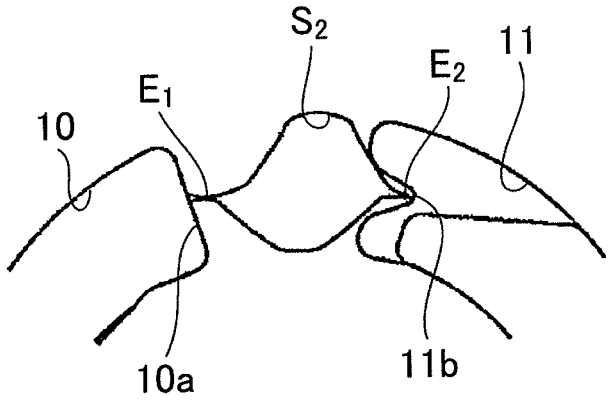
FIG. 3C is a schematic diagram that shows the port configuration of an oil pump that does not have a compression stroke.

The relationship between the compression angle a and the internal pressure of the space at each stroke will be described based on a comparison of an oil pump in which the compression angle is set within a range of 21 to 27 degrees as shown in FIGS. 3A and 3B, and an oil pump in which the compression angle a is set within a range of 0 to 16 degrees as shown in FIG. 3C. Note that FIG. 3A shows an oil pump according to a first embodiment that includes the shallow groove 12; FIG. 3B shows an oil pump according to a second embodiment that does not include the shallow groove 12, and FIG. 3C shows an oil pump that does not have a shallow groove or a compression stroke (an oil pump whose compression angle is 0 degrees).

Figure 4A:
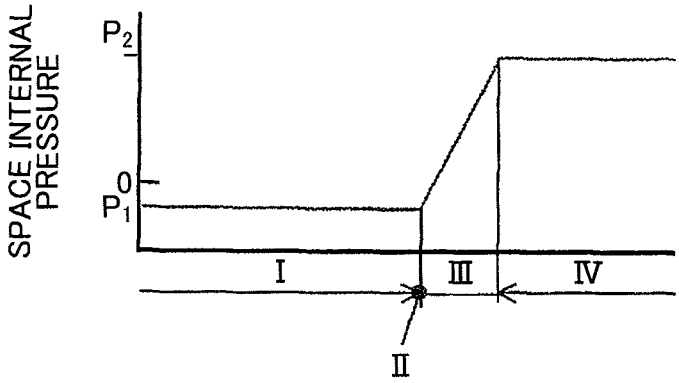
FIG. 4A is a graph that shows the relationship at high revolution between an internal pressure of the inter-rotor space and each stroke in an oil pump whose compression angle is set within a range of 21 to 27 degrees.
Figure 4B:
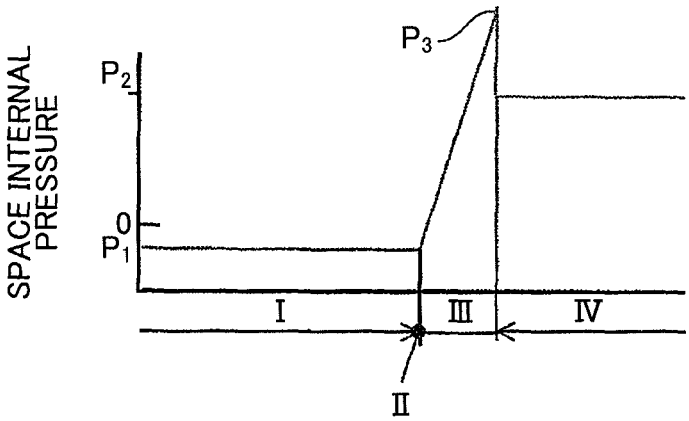
FIG. 4B is a graph that shows the relationship, at low revolution and without the shallow groove for draining pressure, between the internal pressure of the inter-rotor space and each stroke in the oil pump whose compression angle is set within the range of 21 to 27 degrees.
Figure 4C:
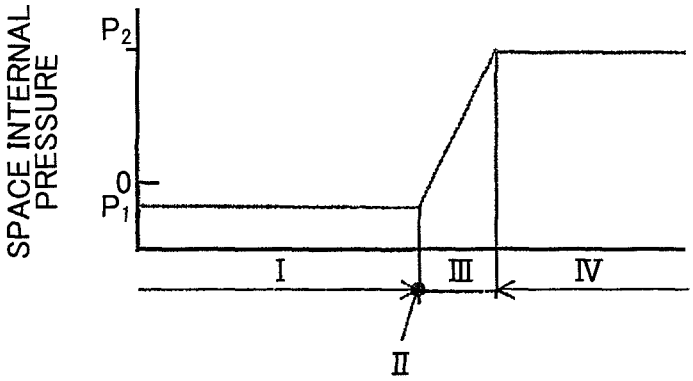
FIG. 4C is a graph that shows the relationship, at low revolution and with the shallow groove for draining pressure, between the internal pressure of the inter-rotor space and each stroke in the oil pump whose compression angle is set within the range of 21 to 27 degrees.
Figure 5A:
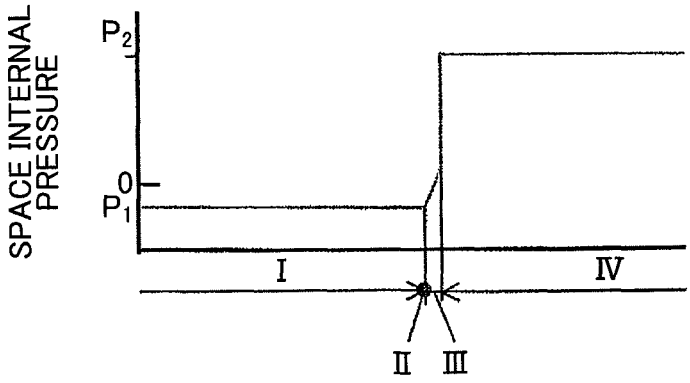
FIG. 5A is a graph that shows the relationship at high revolution between the internal pressure of the inter-rotor space and each stroke in the oil pump whose compression angle is set within a range of 0 to 16 degrees.
Figure 5B:
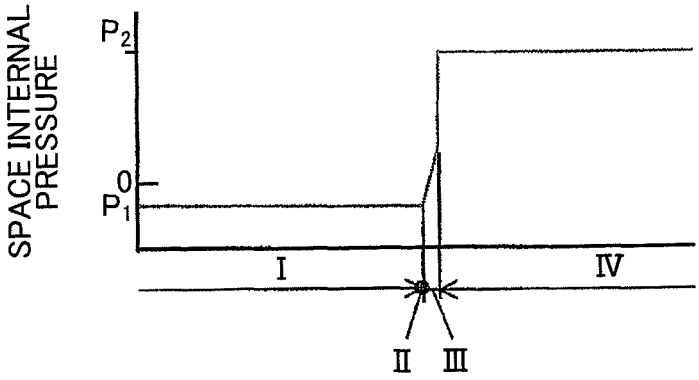
FIG. 5B is a graph that shows the relationship at low revolution between the internal pressure of the inter-rotor space and each stroke in the oil pump whose compression angle is set within the range of 0 to 16 degrees.

FIGS. 4A to 4C show graphs that illustrate the internal pressure of the space at each stroke of an oil pump in which the compression angle a is set within a range of 21 to 27 degrees. FIGS. 5A and 5B show graphs that illustrate the internal pressure of the space at each stroke of an oil pump that does not include the shallow groove 12 and in which the compression angle a is set within a range of 0 to 16 degrees.

In FIGS. 4A to 4C, 5A, and 5B, a comparison of the graphs in FIGS. 4A and 5A at high revolution (4500 to 7000 rpm) clearly shows that when the compression angle a is set within the range of 21 to 27 degrees as in FIG. 4A, the pressure of the space S in the compression stroke III gradually increases from an intake pressure $P_1$ that is a negative pressure to a discharge pressure $P_2$ that is a positive pressure. The compression stroke III ends when the internal pressure of the space S becomes the discharge pressure $P_2$.

Meanwhile, as shown in FIG. 5A, the compression stroke III is short (or does not exist) in the oil pump in which the compression angle a is set within the range of 0 to 16 degrees. Therefore, the discharge stroke IV occurs before the internal pressure of the space S finishes increasing from the intake pressure $P_1$ to the discharge pressure $P_2$, and during this rise in pressure, the internal pressure of the space S suddenly increases to the discharge pressure $P_2$.

In other words, since the existence of cavitation depends on the internal pressure of the space S, when the compression angle a is within the range of 21 to 27 degrees (FIG. 4A), cavitation gradually disappears as the internal pressure of the space S increases during the compression stroke III, and most of the cavitation can be eliminated upon reaching the discharge stroke IV. However, when the compression angle a is 0 to 16 degrees (FIG. 5A), the pressure of the space S suddenly increases to the discharge pressure $P_2$ before the cavitation has a chance to gradually disappear. As a consequence, the elimination of cavitation is not dispersed over time as in the case of FIG. 4A, and the cavitation is collectively eliminated the moment the pressure of the space S reaches the discharge pressure $P_2$.

Examples at low revolution (0 to 4500 rpm) will be described based on FIGS. 4B, 4C, and 5B. As shown in FIG. 5B, when the compression angle a is 0 to 16 degrees, even at low revolution, before the pressure of the space S can gently increase from the intake pressure $P_1$ to the discharge pressure $P_2$, the discharge stroke IV occurs and the pressure of the space S suddenly increases to the discharge pressure $P_2$.

Meanwhile, as shown in FIGS. 4B and 4C, when the compression angle a is 21 to 27 degrees, the internal pressure of the space S during the compression stroke gently increases and there is almost no cavitation at low revolution. Therefore, in the example of FIG. 4B that is not provided with the shallow groove 12 that allows the pressure of the space S to escape, liquid hydraulic oil becomes compressed in the compression stroke III and the pressure becomes a pressure $P_3$ that is higher than the discharge pressure $P_2$. In the example of FIG. 4C that is provided with the shallow groove 12, once the internal pressure of the space S increases, compressed hydraulic oil is discharged from the space S to the discharge port 10 through the shallow groove 12, and the internal pressure of the space S is prevented from becoming larger than the discharge pressure $P_2$.

In light of the relationship between the compression angle a and the internal pressure of the space at each stroke as described above, the relationship between the compression angle a and cavitation noise will be described below.

Figure 6:
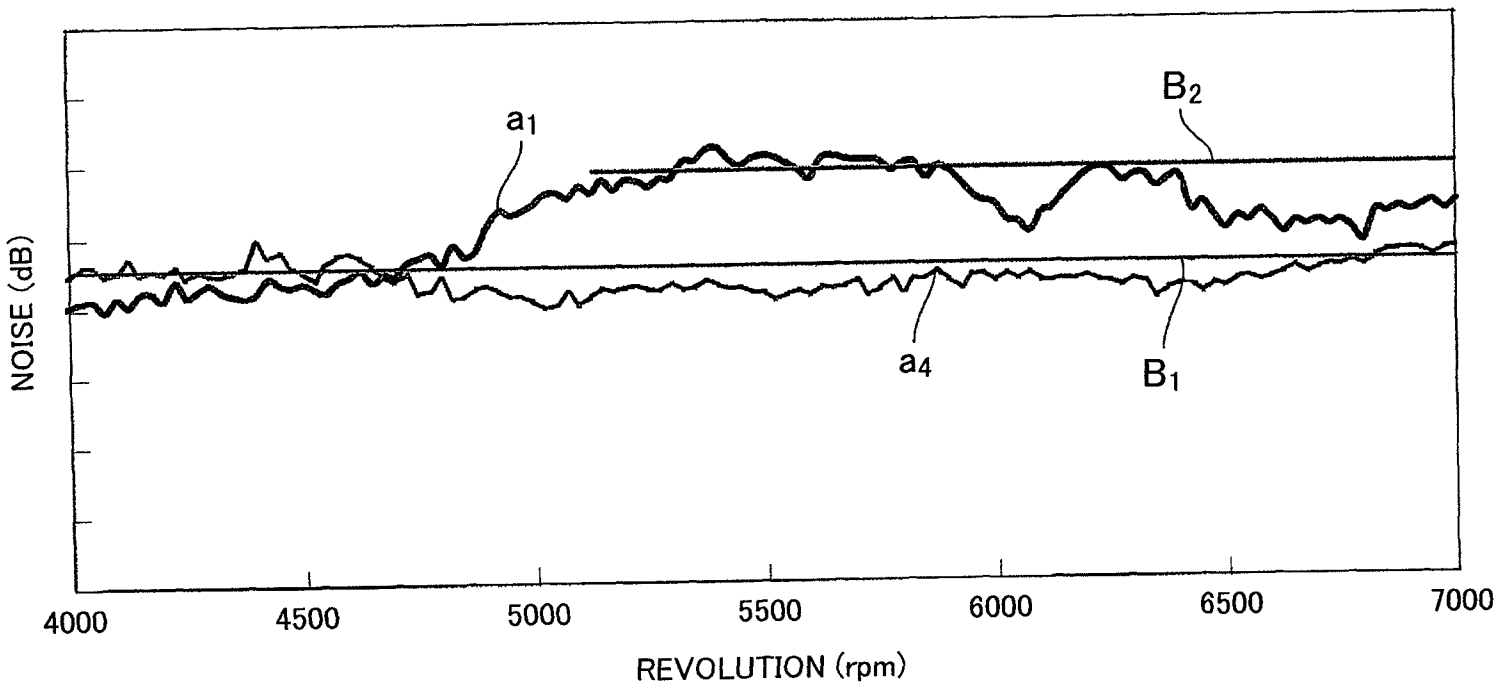
FIG. 6 is a graph that shows the relationship between engine revolutions and oil pump noise at various compression angles.

FIG. 6 is a graph that shows the relationship between the revolutions of the drive source (inner rotor) and noise from the oil pump, wherein $a_1$ shows the compression angle a at 0 degrees, $a_4$ shows the compression angle a at 27 degrees, $B_1$ shows an average of the compression angle a at 21 to 27 degrees, and $B_2$ shows an average of the compression angle a at 0 to 16 degrees.

Referring to $a_1$, noise from the oil pump increases in the vicinity of 4500 rpm. This is because cavitation occurs in the space S when the drive source rotates at high speed, and cavitation noise is generated from the elimination of such cavitation.

Referring to $a_4$, when the compression angle a is 27 degrees, although cavitation occurs at 4500 rpm, oil pump noise does not increase even over 4500 rpm and noise from the oil pump 1 is suppressed. At such time, noise from the oil pump 1 is kept at 80 dB or below.

Comparing $B_2$ that is an average value when the compression angle a is 0 to 16 degrees and $B_1$ that is an average value when the compression angle a is 21 to 27 degrees, $B_1$ has a lower noise volume than $B_2$. In actuality, the average noise for $B_2$ is approximately 90 dB, and 80 dB or less for $B_1$. There is a difference of approximately 10 dB in volume between $B_1$ and $B_2$. Based on this, when the compression angle a is within the range of 0 to 16 degrees (an ineffective compression angle $C_1$ in FIG. 2), almost no cavitation can be eliminated during the compression stroke III and such a range is not effective from the standpoint of suppressing cavitation noise. In order to reduce cavitation noise, it is clear that the compression angle a within the range of 21 to 27 degrees (an effective compression angle $C_2$ in FIG. 2) is more effective.

As described above, in the present embodiment, a confinement stroke II and a compression stroke III are provided between the intake stroke I and the discharge stroke IV. An interval c is set between the finish end portion 11*b* of the intake port 11 and the start end portion 10*a* of the discharge port 10, such that the compression angle a is within a range $C_2$ that spans from an angle (e.g. 27 degrees) at which cavitation occurring at maximum revolution in a high revolution region, among revolution regions of the drive source used during normal vehicle running, disappears to an angle (e.g. 21 degrees) at which noise from the oil pump 1 falls to a predetermined volume or below. Accordingly, almost all cavitation can be gradually smashed and eliminated in the compression stroke III, and oil pump noise can be suppressed to a volume that does not generally cause the driver to feel discomfort.

Note that, when the noise from the oil pump 1 is directly measured as in FIG. 6, the driver generally starts to become bothered by noise from the oil pump 1 in the driver seat when the noise reaches 80 to 85 dB. In the present embodiment, by setting the compression angle a to the effective compression angle $C_2$, noise in the vicinity of the oil pump can be reduced by approximately 10 dB compared to the oil pump using the ineffective compression angle $C_1$. In particular, oil pump noise can be suppressed to a bearable 80 dB or less in a passenger car, and even in a hybrid vehicle that generates little noise when running.

Dispersing and eliminating cavitation over time also enables a reduction in the occurrence of erosion.

Further, an upper limit of the compression angle a is set to an angle that enables the elimination of cavitation occurring at maximum revolution in a high revolution region, among revolution regions of the drive source used during normal vehicle running. Thus, the space S is not compressed by an amount that is more than the amount of cavitation, making it possible to suppress noise from a meshing portion of the external teeth 3*a* and the internal teeth 2*a* caused by the pressure of the space S increasing more than necessary, and also suppress a decrease in fuel economy caused by increased resistance.

Since the shallow groove 12 for draining pressure is provided over the compression angle a, even at low revolution, the internal pressure of the space S can be prevented from increasing more than necessary.

Note that the drive source in the present embodiment is not limited to an engine, and also includes a motor, a hybrid drive system that combines the engine and the motor, and an electric oil pump motor that rotates an oil pump independent of driving in a hybrid vehicle or an electric vehicle.

A hybrid vehicle may run in an EV mode that does not drive the engine at a low vehicle speed, and at a high vehicle speed the oil pump may reach a high driving revolution speed. Oil pump noise may become more noticeable because there is no engine noise while running in EV mode at a low vehicle speed. However, if the present invention is applied to such a hybrid vehicle, such oil pump noise can be reduced and noise caused by cavitation at a high vehicle speed can also be reduced.

A high revolution region among revolution regions of the drive source used during normal vehicle running is set lower than a maximum revolution among the revolution speeds allowed by the drive source. However, the maximum revolution among the high revolution region may be a maximum revolution among the allowed revolution speeds.

The oil pump according to the present invention is not limited to use in an automatic transmission, and may be used as an oil pump for an engine or other hydraulic device. Further, the internal teeth 2*a* and the external teeth 3*a* are not necessarily trochoidal teeth, and may have an ordinary tooth configuration, for example.

The oil pump according to the present invention can be utilized as, for example, an oil pump installed in an automatic transmission, a hybrid drive system, or the like.

What is claimed is:

1. An oil pump comprising:

an inner rotor that has a plurality of external teeth;

an outer rotor that is eccentrically provided and has a plurality of internal teeth that mesh with the external teeth of the inner rotor; and an oil pump body that accommodates the outer rotor and the inner rotor, wherein by rotationally driving the inner rotor to increase and decrease a space part between the internal teeth and the external teeth, an intake stroke that suctions hydraulic oil from an intake port formed in the oil pump body and a discharge stroke that discharges the suctioned hydraulic oil to a discharge port formed in the oil pump body are performed, the intake port communicates with the space part at an interval where the volume of the space part increased, and of which a finish end portion is formed so as to keep communication between the intake port and the space part at the time of the maximum volume of the space part, and between the intake stroke and the discharge stroke, a confinement stroke that cuts off the suctioned hydraulic oil from the intake port and confines the suctioned hydraulic oil in the space part and a compression stroke that reduces the space part and compresses the confined hydraulic oil are performed, and hydraulic oil is prevented from flowing out from the space formed by the internal teeth and the external teeth while the compression stroke is performed due to maintaining a pressure in the space part below a pressure in the discharge port during the compression stroke, and an interval is set between an end portion in a rotation direction side of the inner rotor in the intake port and an end portion in the rotation direction reverse side of the inner rotor in the discharge port such that a rotation angle of the inner rotor during the compression stroke is 21 to 27 degrees.

2. The oil pump according to claim 1, wherein a sliding surface of the oil pump body that slides against the inner rotor is formed with a shallow groove that communicates the discharge port and the space during the compression stroke, wherein the shallow groove is positioned on the locus formed by an engagement point of the internal teeth and the external teeth, and distal end portion of the shallow groove is provided at a position where the rotation angle is advanced approximately 1 to 3 degrees more than 0 degrees with respect to the engagement point in a rotation direction side of the inner rotor at the time of termination of the confinement stroke.

* * * * *